US010199205B2

(12) United States Patent
Gordon et al.

(10) Patent No.: US 10,199,205 B2
(45) Date of Patent: Feb. 5, 2019

(54) COMPACT MASS SPECTROMETER

(71) Applicant: Micromass UK Limited, Wilmslow (GB)

(72) Inventors: David Gordon, Manchester (GB); Daniel James Kenny, Knutsford (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/852,412

(22) Filed: Dec. 22, 2017

(65) Prior Publication Data

US 2018/0144917 A1 May 24, 2018

Related U.S. Application Data

(63) Continuation of application No. 15/388,368, filed on Dec. 22, 2016, now Pat. No. 9,852,894, which is a (Continued)

(30) Foreign Application Priority Data

May 31, 2013 (EP) ..... 13170146
May 31, 2013 (GB) ..... 1309768.8
May 31, 2013 (GB) ..... 1309770.4

(51) Int. Cl.
*H01J 49/00* (2006.01)
*H01J 49/24* (2006.01)
(Continued)

(52) U.S. Cl.
CPC ..... *H01J 49/0013* (2013.01); *H01J 49/0031* (2013.01); *H01J 49/10* (2013.01);
(Continued)

(58) Field of Classification Search
CPC .... H01J 49/0013; H01J 49/0031; H01J 49/10; H01J 49/40; H01J 49/24; H01J 49/062
(Continued)

(56) References Cited

U.S. PATENT DOCUMENTS 4,963,736 A 10/1990 Douglas et al.
5,164,593 A 11/1992 Chapman et al.
(Continued)

OTHER PUBLICATIONS

Malcolm et al., "A Miniature Mass Spectrometer for Liquid Chromatography Applications", Rapid Communications in Mass Spectrometry, vol. 25, pp. 3281-3288, (2011).
(Continued)

*Primary Examiner* — Michael Maskell
(74) *Attorney, Agent, or Firm* — Womble Bond Dickinson (US) LLP; Deborah M. Vernon; Heath T. Misley

(57) ABSTRACT

A miniature mass spectrometer is disclosed comprising an atmospheric pressure ionization source and a first vacuum chamber having an atmospheric pressure sampling orifice or capillary, a second vacuum chamber located downstream of the first vacuum chamber and a third vacuum chamber located downstream of the second vacuum chamber. An ion detector is located in the third vacuum chamber. A first RF ion guide is located within the first vacuum chamber and a second RF ion guide is located within the second vacuum chamber. The ion path length from the atmospheric pressure sampling orifice or capillary to an ion detecting surface of the ion detector is ≤400 mm. The mass spectrometer further comprises a tandem quadrupole mass analyzer, a 3D ion trap mass analyzer, a 2D or linear ion trap mass analyzer, a Time of Flight mass analyzer, a quadrupole-Time of Flight mass analyzer or an electrostatic mass analyzer arranged in the third vacuum chamber. The product of the pressure $P_1$ in the vicinity of the first RF ion guide and the length $L_1$ of the first RF ion guide is in the range 10-100 mbar-cm and the product
(Continued)

of the pressure $P_2$ in the vicinity of the second RF ion guide and the length $L_2$ of the second RF ion guide is in the range 0.05-0.3 mbar-cm.

19 Claims, 6 Drawing Sheets

Related U.S. Application Data continuation of application No. 14/892,360, filed as application No. PCT/GB2014/051643 on May 29, 2014, now Pat. No. 9,530,631.

(51) Int. Cl.
*H01J 49/10* (2006.01)
*H01J 49/40* (2006.01)
*H01J 49/14* (2006.01)
*H01J 49/06* (2006.01)

(52) U.S. Cl.
CPC ..... *H01J 49/145* (2013.01); *H01J 49/24* (2013.01); *H01J 49/40* (2013.01); *H01J 49/062* (2013.01)

(58) Field of Classification Search
USPC ..... 250/281, 282
See application file for complete search history.

(56) References Cited

U.S. PATENT DOCUMENTS 6,107,623 A * 8/2000 Bateman ..... H01J 49/4215 250/282
6,528,784 B1 3/2003 Tang et al.
6,753,523 B1 6/2004 Whitehouse et al.
7,256,395 B2 8/2007 Collings et al.
7,259,371 B2 8/2007 Collings et al.
RE40,632 E 2/2009 Tang et al.
7,786,434 B2 8/2010 Syms et al.
7,960,692 B2 6/2011 Dobson et al.
8,148,681 B2 4/2012 Syms et al.
8,471,199 B1 6/2013 Doroshenko et al.
8,487,247 B2 7/2013 Prosser et al.
8,507,847 B2 8/2013 Wright et al.
8,558,167 B2 10/2013 Wright
8,581,181 B2 11/2013 Giles
8,669,518 B2 3/2014 Ishiguro et al.
8,740,588 B2 6/2014 Stones
8,796,616 B2 8/2014 Wright et al.
9,530,631 B2 * 12/2016 Gordon ..... H01J 49/0013
2010/0078553 A1 4/2010 Corso et al.
2011/0036980 A1 2/2011 Lisa et al.
2011/0240849 A1 * 10/2011 Wright ..... H01J 49/0013 250/288
2012/0138790 A1 * 6/2012 Wright ..... H01J 49/0013 250/288
2016/0093480 A1 3/2016 Gordon et al.
2016/0111266 A1 4/2016 Gordon et al.
2016/0118238 A1 4/2016 Gordon et al.

OTHER PUBLICATIONS

MT Explorer, Aug. 2012.
MT Explorer 100, Jun. 2011.

* cited by examiner

COMPACT MASS SPECTROMETER

This application is a continuation of U.S. patent application Ser. No. 15/388,368, filed 22 Dec. 2016 which will issue as U.S. Pat. No. 9,852,894 on 26 Dec. 2017, which is a continuation of U.S. application Ser. No. 14/892,360, filed 19 Nov. 2015, which issued as U.S. Pat. No. 9,530,631 on Dec. 27, 2016, which is the National Stage of International Application No. PCT/GB2014/051643, filed 29 May 2014, which claims priority from and the benefit of United Kingdom patent application No. 1309768.8 filed on 31 May 2013, United Kingdom patent application No. 1309770.4 filed on 31 May 2013 and European patent application No. 13170146.8 filed on 31 May 2013. The entire contents of these applications are incorporated herein by reference.

BACKGROUND OF THE PRESENT INVENTION

The present invention relates to a mass spectrometer and a method of mass spectrometry. The preferred embodiment relates to a compact or miniature mass spectrometer in conjunction with an Atmospheric Pressure Ionisation ("API") ion source.

Conventional mass analysers are normally unable to operate at or near atmospheric pressure and so are located within a vacuum chamber that is evacuated to a low pressure. Most commercial mass analysers operate at a vacuum level of $1\times10^{-4}$ mbar or lower.

Mass spectrometers with Atmospheric Pressure Ionisation ("API") ion sources utilise a sampling orifice or capillary in or near the ion source to allow the ions that are created at atmospheric pressure ("AP") to be admitted into the vacuum chamber containing the mass analyser.

There has been significant development to identify the most efficient method of transferring ions from atmospheric pressure to a vacuum chamber containing the mass analyser. A single orifice between the ion source at atmospheric pressure and the mass analyser is the most direct method but is generally impractical since either the atmospheric pressure orifice needs to be made so small that the number of ions transmitted into the vacuum chamber will be very low (thereby severely restricting the sensitivity of the instrument) or alternatively the mass spectrometer requires an impractically large vacuum pump.

In view of these problems it is common to use one or more stages of differential pumping whereby the pressure is reduced in stages through consecutive vacuum regions each with a small orifice into the adjacent chamber.

It is known to use a rotary vacuum pump to pump a first differential pumping region and one or more turbomolecular vacuum pumps to pump subsequent vacuum regions. Turbomolecular vacuum pumps are unable to exhaust to atmosphere and hence a vacuum pump is required as a backing vacuum pump to the turbomolecular vacuum pump. It is known to use a single rotary vacuum pump to provide pumping for a first stage of differential pumping and also to act as a backing vacuum pump for a turbomolecular vacuum pump.

The sensitivity of a mass spectrometer (which is a key performance characteristic) is closely related to the pumping speeds of the vacuum pumps which are utilised and the gas throughput that the vacuum pumps are able to displace. The pumping speed is the volume flow rate of a vacuum pump and so at higher pumping speed a vacuum pump will be able to displace more gas. Simplistically, vacuum pumps with larger pumping speeds allow mass spectrometers with larger orifices to be constructed (whilst maintaining a similar pressure in a given region) which allow more ions to pass through the orifice thereby increasing the sensitivity of the instrument.

State of the art mass spectrometers have an entrance orifice or capillary(s) that allows a gas throughput from an API ion source into a first differential pumping region of approximately 1000 to 6000 sccm (standard cubic centimeters per minute).

FIG. 1 shows the effect of varying the diameter of an atmospheric pressure sampling orifice upon ion transmission (and hence sensitivity) in relation to a single quadrupole mass spectrometer. In order to generate the data shown in FIG. 1 a valve was used to throttle the pumping in a first differential pumping region in order to keep the pressure in this region the same for each measurement. As can be seen from FIG. 1, a reduction in diameter of the atmospheric pressure sampling orifice from 0.5 mm to 0.15 mm resulted in a reduction in ion transmission to approx. 50%.

FIG. 2 shows the results of a corresponding experiment wherein the diameter of an orifice between first and second stages of differential pumping of a mass spectrometer was varied. As the orifice was reduced from 0.97 mm to 0.6 mm the ion transmission was reduced by >50%.

Conventional single quadrupole mass spectrometers which utilise an Electrospray ("ESI") ion source use a rotary vacuum pump having a pumping speed in the range 30-65 $m^3$/hr. A turbomolecular vacuum pump with a pumping speed of approximately 300 L/s is commonly used to pump the analyser chamber. The rotary pump also acts as a backing pump to the turbomolecular pump. It will be appreciated that a state of the art single quadrupole mass analyser the mass spectrometer utilises large heavy vacuum pumps. For example, a Leybold SV40 rotary vacuum pump measures 500 mm×300 mm×300 mm and weighs 43 kg and a Pfeiffer splitflow turbomolecular vacuum pump measures 400 mm×165 mm×150 mm and weighs 14 kg.

A compact or miniature mass spectrometer is known and will be discussed in further detail below.

The manufacture of a compact or miniature mass spectrometer advantageously enables physically smaller and lighter vacuum pumps to be utilised. Consequently, these vacuum pumps have lower pumping speeds and therefore in order to maintain the same level of vacuum within the regions of the mass spectrometer as a full size mass spectrometer, smaller orifices must be used. However, replacing a conventional sized orifice with a smaller orifice is problematic since the smaller orifice will have a detrimental effect upon the sensitivity of the instrument. Reducing the sensitivity of the instrument will limit the usefulness of the miniature mass spectrometer and make it less commercially viable.

A known miniature mass spectrometer is disclosed in FIG. 9 of US 2012/0138790 (Microsaic) and Rapid Commun. Mass Spectrom. 2011, 25, 3281-3288. The miniature mass spectrometer as shown in FIG. 9 of US 2012/0138790 comprises a three stage vacuum system. The first vacuum chamber comprises a vacuum interface. The vacuum interface is maintained at a pressure of >67 mbar (>50 Torr) which will be understood by those skilled in the art to be relatively very high. A small first diaphragm vacuum pump is used to pump the vacuum interface.

The second vacuum chamber contains a short RF ion guide which is operated at a pressure-path length in the range 0.01-0.02 Torr·cm and is vacuum pumped by a first turbomolecular vacuum pump which is backed by a second diaphragm vacuum pump. The second separate diaphragm vacuum pump is required due to the relative high pressure (>67 mbar) of the first vacuum chamber. The high pressure in the first vacuum chamber effectively prevents the same diaphragm vacuum pump from being used to back both the first turbomolecular vacuum pump and also to pump the first vacuum chamber due to the fact that turbomolecular vacuum pumps are generally only able to operate with backing pressures of <20 mbar.

The known miniature mass spectrometer therefore requires two diaphragm vacuum pumps in addition to two turbomolecular vacuum pumps or a split-flow turbomolecular vacuum pump.

FIG. 1 of US 2011/02040849 (Wright) discloses a miniature mass spectrometer having a second vacuum chamber which is maintained at a pressure of $10^{-4}$ to $10^{-2}$ Torr ($1.3\times10^{-4}$ mbar to $1.3\times10^{-2}$ mbar) and having an ion guide disposed within the second vacuum chamber. The length of the ion guide is not stated.

It is desired to provide an improved mass spectrometer and method of mass spectrometry.

SUMMARY OF THE PRESENT INVENTION

According to an aspect of the present invention there is provided a miniature mass spectrometer comprising:

an atmospheric pressure ionisation source;

a first vacuum chamber having an atmospheric pressure sampling orifice or capillary, a second vacuum chamber located downstream of the first vacuum chamber and a third vacuum chamber located downstream of the second vacuum chamber;

an ion detector located in the third vacuum chamber;

a first RF ion guide located within the first vacuum chamber;

a second RF ion guide located within the second vacuum chamber;

wherein the ion path length from the atmospheric pressure sampling orifice or capillary to an ion detecting surface of the ion detector is ≤400 mm;

wherein the mass spectrometer further comprises:

a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber;

wherein the product of the pressure $P_1$ in the vicinity of the first RF ion guide and the length $L_1$ of the first RF ion guide is in the range 10-100 mbar-cm; and wherein the product of the pressure $P_2$ in the vicinity of the second RF ion guide and the length $L_2$ of the second RF ion guide is in the range 0.05-0.3 mbar-cm.

According to an aspect of the present invention there is provided a miniature mass spectrometer comprising:

an atmospheric pressure ionisation source;

a first vacuum chamber having an atmospheric pressure sampling orifice or capillary, a second vacuum chamber located downstream of the first vacuum chamber, a third vacuum chamber located downstream of the second vacuum chamber and a fourth vacuum chamber located downstream of the third vacuum chamber;

an ion detector located in the fourth vacuum chamber;

a first RF ion guide located within the first vacuum chamber;

a second RF ion guide located within the second vacuum chamber;

wherein the ion path length from the atmospheric pressure sampling orifice or capillary to an ion detecting surface of the ion detector is ≤400 mm;

wherein the mass spectrometer further comprises:

a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber and/or the fourth vacuum chamber;

wherein the product of the pressure $P_1$ in the vicinity of the first RF ion guide and the length $L_1$ of the first RF ion guide is in the range 10-100 mbar-cm; and wherein the product of the pressure $P_2$ in the vicinity of the second RF ion guide and the length $L_2$ of the second RF ion guide is in the range 0.05-0.3 mbar-cm.

A quadrupole mass filter is preferably arranged in the third vacuum chamber.

A Time of Flight mass analyser is preferably arranged in the fourth vacuum chamber.

The mass spectrometer preferably further comprises one or more collision, fragmentation or reaction cells arranged in the second vacuum chamber.

The mass spectrometer preferably further comprises one or more collision, fragmentation or reaction cells arranged in the third vacuum chamber.

The mass spectrometer preferably further comprises one or more collision, fragmentation or reaction cells arranged in the fourth vacuum chamber.

The one or more collision, fragmentation or reaction cells are preferably selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The term "miniature mass spectrometer" should be understood as meaning a mass spectrometer which is physically smaller and lighter than a conventional full size mass spectrometer and which utilises vacuum pumps having lower maximum pumping speeds than a conventional full size mass spectrometer. The term "miniature mass spectrometer" should therefore be understood as comprising a mass spectrometer which utilises a small pump (e.g. with a maximum pumping speed of ≤10 $m^3$/hr) to pump the first vacuum chamber.

According to preferred embodiment the product of the pressure P in the vicinity of the (second) RF ion guide and the length L of the RF ion guide is preferably in the range 0.1-0.3 mbar-cm. According to a particularly preferred embodiment the pressure-length value is 0.17 mbar-cm. By way of contrast, the known miniature mass spectrometer utilises an RF ion guide in a vacuum chamber with a pressure-length value of approx. 0.01 mbar-cm i.e. the RF ion guide according to the preferred embodiment is operated at a much higher pressure-length value which is approx. an order of magnitude greater than that of the known miniature mass spectrometer. The higher pressure-length value according to the preferred embodiment is particularly advantageous in that it enables ions to be axially accelerated (using e.g. a DC voltage gradient or a travelling wave comprising one or more transient DC voltages which are applied to the electrodes of the ion guide) and collisionally cooled to ensure that the ions have a small spread of ion energies. In contrast, the lower pressure-length value utilised with the known miniature mass spectrometer is insufficient to enable ions to be axially accelerated and also collisionally cooled sufficiently to ensure that the ions have a small spread of ion energies.

It will be appreciated, therefore, that the higher pressure-length according to the preferred embodiment is particularly advantageous compared with the known miniature mass spectrometer.

FIG. 1 of US 2011/02040849 (Wright) discloses a miniature mass spectrometer having a second vacuum chamber which is maintained at a pressure of $10^{-4}$ to $10^{-2}$ Torr ($1.3\times10^{-4}$ mbar to $1.3\times10^{-2}$ mbar) and having an ion guide disposed within the second vacuum chamber. The length of the ion guide is not stated. An RF ion guide is not provided in the first vacuum chamber.

The miniature mass spectrometer preferably further comprises a first vacuum pump arranged and adapted to pump the first vacuum chamber.

The first vacuum pump preferably comprises a rotary vane vacuum pump or a diaphragm vacuum pump. A particular advantage of the miniature mass spectrometer according to the preferred embodiment is that unlike the known miniature mass spectrometer which requires two diaphragm vacuum pumps in addition to a turbomolecular vacuum pump, the miniature mass spectrometer according to the preferred embodiment only requires a single diaphragm or equivalent vacuum pump in addition to a turbomolecular pump.

The first vacuum pump preferably has a maximum pumping speed ≤10 $m^3$/hr (2.78 L/s).

Conventional full size mass spectrometers typically utilise a rotary pump having a pumping speed of at least 30 $m^3$/hr (8.34 L/s). It will be appreciated, therefore, that the miniature mass spectrometer according to the preferred embodiment utilises a much smaller pump than a conventional full size mass spectrometer. According to a particularly preferred embodiment the first vacuum pump has a maximum pumping speed of approximately 1 $m^3$/hr (0.28 L/s).

The first vacuum pump is preferably arranged and adapted to maintain the first vacuum chamber at a pressure <10 mbar. This is significantly different to the known miniature mass spectrometer as disclosed in Rapid Commun. Mass Spectrom. 2011, 25, 3281-3288 (Microsaic) wherein the vacuum interface is maintained at a high pressure of >67 mbar. According to a particularly preferred embodiment the first vacuum chamber is maintained at a pressure of 4 mbar i.e. at least an order of magnitude lower.

The mass spectrometer preferably further comprises an ion detector located in the third vacuum chamber.

The ion path length from the atmospheric pressure sampling orifice or capillary to an ion detecting surface of the ion detector is preferably ≤400 mm. According to a particularly preferred embodiment the ion path length is approximately 355 mm. It will be appreciated that the ion path length according to the preferred embodiment is substantially shorter than a comparable ion path length of a full size mass spectrometer.

The first vacuum chamber preferably has an internal volume ≤500 $cm^3$. According to a particularly preferred embodiment the first vacuum chamber has an internal volume of approximately 340 $cm^2$.

The second vacuum chamber preferably has an internal volume ≤500 $cm^3$. According to a particularly preferred embodiment the second vacuum chamber has an internal volume of approximately 280 $cm^2$.

The third vacuum chamber preferably has an internal volume ≤2000 $cm^3$. According to a particularly preferred embodiment the third vacuum chamber has an internal volume of approximately 1210 $cm^2$.

The total internal volume of the first, second and third vacuum chambers is preferably ≤2000 $cm^3$. According to a particularly preferred embodiment the combined internal volumes of the first, second and third vacuum chambers is approximately 1830 $cm^2$. It will be appreciated that this is substantially smaller than the combined internal volume of the vacuum chambers of a full size single quadrupole mass spectrometer which typically have a combined internal volume of approximately 4000 $cm^3$.

The atmospheric pressure ionisation source preferably comprises an Electrospray ionisation ion source, a microspray ionisation ion source, a nanospray ionisation ion source or a chemical ionisation ion source.

The first and/or second RF ion guides preferably comprise a dual conjoined stacked ring ion guide, a multipole ion guide, a stacked ring ion guide or an ion funnel ion guide. According to an embodiment the first and/or second RF ion guides may comprise a quadrupole, hexapole or octapole ion guide comprising rod electrodes having a diameter of approximately 6 mm.

The first and/or second RF ion guide preferably has a length <100 mm. According to a particularly preferred embodiment the first and/or second RF ion guide has a length of approximately 82 mm.

The atmospheric pressure sampling orifice or capillary preferably has a diameter ≤0.3 mm. According to a particularly preferred embodiment the atmospheric pressure sampling orifice or capillary has a diameter of 0.1 mm which is substantially smaller than that atmospheric pressure sampling orifice of the known miniature mass spectrometer which is 0.3 mm.

The atmospheric pressure sampling orifice or capillary preferably has a gas throughput ≤850 sccm. According to a particularly preferred embodiment the atmospheric pressure sampling orifice or capillary has a gas throughput of 90 sccm. This is substantially smaller than that of the known miniature mass spectrometer which has a gas throughput of approximately 840 sccm.

The miniature mass spectrometer preferably further comprises a differential pumping aperture or orifice between the first vacuum chamber and the second vacuum chamber.

The differential pumping aperture or orifice between the first vacuum chamber and the second vacuum chamber preferably has a diameter ≤1.5 mm. According to a particularly preferred embodiment the differential pumping aperture or orifice is approximately 1.0 mm.

The differential pumping aperture or orifice between the first vacuum chamber and the second vacuum chamber preferably has a gas throughput ≤50 sccm. According to a particularly preferred embodiment the differential pumping aperture or orifice has a gas throughput of approximately 32 sccm.

The second vacuum chamber is preferably arranged to be maintained at a pressure in the range 0.001-0.1 mbar. According to a particularly preferred embodiment the second vacuum chamber is maintained at a pressure of approximately 0.021 mbar.

The miniature mass spectrometer preferably further comprises a mass analyser arranged in the third vacuum chamber.

The mass analyser preferably comprises a quadrupole mass analyser. According to a particularly preferred embodiment the quadrupole mass analyser comprises four rod electrodes which are approximately 8 mm in diameter. By way of comparison, a known full size mass spectrometer utilises rod electrodes which are 12 mm in diameter.

The miniature mass spectrometer preferably further comprises a differential pumping aperture or orifice between the second vacuum chamber and the third vacuum chamber.

The differential pumping aperture or orifice between the second vacuum chamber and the third vacuum chamber preferably has a diameter 2.0 mm. According to a particularly preferred embodiment the differential pumping aperture or orifice is approximately 1.5 mm in diameter.

The differential pumping aperture or orifice between the second vacuum chamber and the third vacuum chamber preferably has a gas throughput 5-1 sccm. According to a particularly preferred embodiment the gas throughput is approximately 0.25 sccm.

The third vacuum chamber is preferably arranged to be maintained at a pressure <0.0003 mbar.

The miniature mass spectrometer preferably further comprises a second vacuum pump arranged and adapted to pump the second vacuum chamber and the third vacuum chamber.

The second vacuum pump preferably comprises a split flow turbomolecular vacuum pump.

The first vacuum pump is preferably arranged and adapted to act as a backing vacuum pump to the second vacuum pump.

The second vacuum pump preferably comprises an intermediate or interstage port connected to the second vacuum chamber and a high vacuum ("HV") port connected to the third vacuum chamber.

The second vacuum pump is preferably arranged to pump the second vacuum chamber via the intermediate or interstage port at a maximum pumping speed ≤70 L/s. It will be understood that pumping the second vacuum chamber at a maximum pumping speed of 70 L/s is substantially lower than conventional full size mass spectrometers wherein the intermediate port of a splitflow turbomolecular pump is typically pumping at speeds of 200 L/s.

The second vacuum pump is preferably arranged to pump the second vacuum chamber via the intermediate or interstage port at a maximum pumping speed in the range 15-70 L/s. According to a particularly preferred embodiment the second vacuum chamber is pumped at a speed of approximately 25 L/s. It will be understood that the second vacuum chamber is preferably pumped at a higher speed than the second vacuum chamber of the known miniature mass spectrometer which is pumped at a speed of 8-9 L/s.

The second vacuum pump is preferably arranged to pump the third vacuum chamber via the high vacuum port at a maximum pumping speed in the range 40-80 L/s. According to a particularly preferred embodiment the second vacuum pump is operated at a pumping speed of approximately 62 L/s. It will be understood that pumping the third vacuum chamber at a maximum pumping speed of 40-80 L/s is substantially lower than conventional full size mass spectrometer wherein the HV port of a splitflow turbomolecular pump is typically pumping at speeds of 300 L/s.

According to the preferred embodiment the first vacuum chamber is pumped with a rotary pump operating at a frequency of 25-30 Hz and rotating at 15,000-18,000 rpm. The second and third vacuum chambers are preferably pumped by one or more small turbomolecular pumps at a high rate of 90,000 rpm (c.f. full size turbomolecular pumps as utilised by a full size mass spectrometer which typically operate at 60,000 rpm).

The miniature mass spectrometer preferably further comprises a second vacuum pump arranged and adapted to pump the second vacuum chamber.

The second vacuum pump preferably comprises a first turbomolecular vacuum pump.

The second vacuum pump preferably has a maximum pumping speed ≤70 L/s.

The second vacuum pump preferably has a maximum pumping speed in the range 15-70 L/s.

The miniature mass spectrometer preferably further comprises a third vacuum pump arranged and adapted to pump the third vacuum chamber.

The third vacuum pump preferably comprises a second turbomolecular vacuum pump.

The third vacuum pump preferably has a maximum pumping speed in the range 40-80 L/s.

The first vacuum pump is preferably arranged and adapted to act as a backing vacuum pump to the second vacuum pump and/or the third vacuum pump.

According to an aspect of the present invention there is provided a method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber, a third vacuum chamber located downstream of the second vacuum chamber, an ion detector located in the third vacuum chamber, a first RF ion guide located within the first vacuum chamber, a second RF ion guide located within the second vacuum chamber, wherein the ion path length from the atmospheric pressure sampling orifice or capillary to an ion detecting surface of the ion detector is ≤400 mm;

providing a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber;

maintaining the product of the pressure $P_1$ in the vicinity of the first RF ion guide and the length $L_1$ of the first RF ion guide in the range 10-100 mbar-cm;

maintaining the product of the pressure $P_2$ in the vicinity of the second RF ion guide and the length $L_2$ of the second RF ion guide in the range 0.05-0.3 mbar-cm; and passing analyte ions through the second RF ion guide.

According to an aspect of the present invention there is provided a method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber, a third vacuum chamber located downstream of the second vacuum chamber, a fourth vacuum chamber located downstream of the third vacuum chamber, an ion detector located in the fourth vacuum chamber, a first RF ion guide located within the first vacuum chamber, a second RF ion guide located within the second vacuum chamber, wherein the ion path length from the atmospheric pressure sampling orifice or capillary to an ion detecting surface of the ion detector is ≤400 mm;

providing a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber and/or the fourth vacuum chamber;

maintaining the product of the pressure $P_1$ in the vicinity of the first RF ion guide and the length $L_1$ of the first RF ion guide in the range 10-100 mbar-cm;

maintaining the product of the pressure $P_2$ in the vicinity of the second RF ion guide and the length $L_2$ of the second RF ion guide in the range 0.05-0.3 mbar-cm; and passing analyte ions through the second RF ion guide.

According to an aspect of the present invention there is provided a miniature mass spectrometer comprising:

an atmospheric pressure ionisation source;

a first vacuum chamber having an atmospheric pressure sampling orifice or capillary, a second vacuum chamber located downstream of the first vacuum chamber and a third vacuum chamber located downstream of the second vacuum chamber;

an ion detector located in the third vacuum chamber;

an RF ion guide located within the second vacuum chamber;

wherein the ion path length from the atmospheric pressure sampling orifice or capillary to an ion detecting surface of the ion detector is ≤400 mm;

wherein the mass spectrometer further comprises:

a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber;

wherein the product of the pressure $P_1$ in the the first vacuum chamber and the length $L_1$ of the first vacuum chamber is in the range 10-100 mbar-cm; and wherein the product of the pressure $P_2$ in the vicinity of the RF ion guide and the length $L_2$ of the RF ion guide is in the range 0.05-0.3 mbar-cm.

According to an aspect of the present invention there is provided a miniature mass spectrometer comprising:

an atmospheric pressure ionisation source;

a first vacuum chamber having an atmospheric pressure sampling orifice or capillary, a second vacuum chamber located downstream of the first vacuum chamber, a third vacuum chamber located downstream of the second vacuum chamber and a fourth vacuum chamber located downstream of the third vacuum chamber;

an ion detector located in the fourth vacuum chamber;

an RF ion guide located within the second vacuum chamber;

wherein the ion path length from the atmospheric pressure sampling orifice or capillary to an ion detecting surface of the ion detector is ≤400 mm;

wherein the mass spectrometer further comprises:

a tandem quadrupole mass analyser, a 3D ion trap mass analyser, a 2D or linear ion trap mass analyser, a Time of Flight mass analyser, a quadrupole-Time of Flight mass analyser or an electrostatic mass analyser arranged in the third vacuum chamber and/or the fourth vacuum chamber;

wherein the product of the pressure $P_1$ in the the first vacuum chamber and the length $L_1$ of the first vacuum chamber is in the range 10-100 mbar-cm; and wherein the product of the pressure $P_2$ in the vicinity of the RF ion guide and the length $L_2$ of the RF ion guide is in the range 0.05-0.3 mbar-cm.

According to an aspect of the present invention there is provided a method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber, a third vacuum chamber located downstream of the second vacuum chamber, an ion detector located in the third vacuum chamber, an RF ion guide located within the second vacuum chamber, wherein the ion path length from the atmospheric pressure sampling orifice or capillary to an ion detecting surface of the ion detector is ≤400 mm;

providing a tandem quadrupole mass analyser, a 3D ion trap mass analyser, a 2D or linear ion trap mass analyser, a Time of Flight mass analyser, a quadrupole-Time of Flight mass analyser or an electrostatic mass analyser in the third vacuum chamber;

maintaining the product of the pressure $P_1$ in the first vacuum chamber and the length $L_1$ of the first vacuum chamber in the range 10-100 mbar-cm;

maintaining the product of the pressure $P_2$ in the vicinity of the RF ion guide and the length $L_2$ of the RF ion guide in the range 0.05-0.3 mbar-cm; and passing analyte ions through the RF ion guide.

According to an aspect of the present invention there is provided a method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber, a third vacuum chamber located downstream of the second vacuum chamber, a fourth vacuum chamber located downstream of the third vacuum chamber, an ion detector located in the fourth vacuum chamber, an RF ion guide located within the second vacuum chamber, wherein the ion path length from the atmospheric pressure sampling orifice or capillary to an ion detecting surface of the ion detector is 400 mm;

providing a tandem quadrupole mass analyser, a 3D ion trap mass analyser, a 2D or linear ion trap mass analyser, a Time of Flight mass analyser, a quadrupole-Time of Flight mass analyser or an electrostatic mass analyser in the third vacuum chamber and/or the fourth vacuum chamber;

maintaining the product of the pressure $P_1$ in the first vacuum chamber and the length $L_1$ of the first vacuum chamber in the range 10-100 mbar-cm;

maintaining the product of the pressure $P_2$ in the vicinity of the RF ion guide and the length $L_2$ of the RF ion guide in the range 0.05-0.3 mbar-cm; and passing analyte ions through the RF ion guide.

According to an aspect of the present invention there is provided a miniature mass spectrometer comprising:

an atmospheric pressure ionisation source; and a first vacuum chamber having an atmospheric pressure sampling orifice or capillary, a second vacuum chamber located downstream of the first vacuum chamber and a third vacuum chamber located downstream of the second vacuum chamber;

wherein the mass spectrometer further comprises:

an RF ion guide located within the second vacuum chamber and wherein the product of the pressure P in the vicinity of the RF ion guide and the length L of the RF ion guide is in the range 0.05-0.3 mbar-cm.

According to an aspect of the present invention there is provided a method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber and a third vacuum chamber located downstream of the second vacuum chamber; and passing analyte ions through an RF ion guide located within the second vacuum chamber; and maintaining the product of the pressure P in the vicinity of the RF ion guide and the length L of the RF ion guide in the range 0.05-0.3 mbar-cm.

According to an aspect of the present invention there is provided a mass spectrometer comprising:

an atmospheric pressure ionisation source;

a first vacuum chamber having an atmospheric pressure sampling orifice or capillary, a second vacuum chamber located downstream of the first vacuum chamber and a third vacuum chamber located downstream of the second vacuum chamber;

an RF ion guide located within the second vacuum chamber and wherein the product of the pressure P in the vicinity of the RF ion guide and the length L of the RF ion guide is in the range 0.05-0.3 mbar-cm; and a first vacuum pump arranged and adapted to maintain the first vacuum chamber at a pressure <25 mbar and wherein the first vacuum pump has a maximum pumping speed <10 $m^3$/hr (2.78 Us).

The mass spectrometer preferably further comprises one or more vacuum pumps arranged and adapted to pump the second vacuum chamber at a maximum rate of ≤70 L/s.

According to an aspect of the present invention there is provided a method of mass spectrometry comprising:

providing a mass spectrometer comprising an atmospheric pressure ionisation source, a first vacuum chamber having an atmospheric pressure sampling orifice or capillary, a second vacuum chamber located downstream of the first vacuum chamber and a third vacuum chamber located downstream of the second vacuum chamber;

passing analyte ions through an RF ion guide located within the second vacuum chamber;

maintaining the product of the pressure P in the vicinity of the RF ion guide and the length L of the RF ion guide in the range 0.05-0.3 mbar-cm; and maintaining the first vacuum chamber at a pressure <25 mbar using a first vacuum pump having a maximum pumping speed <10 $m^3$/hr (2.78 L/s).

The method preferably further comprises using one or more vacuum pumps to pump the second vacuum chamber at a maximum rate of ≤70 L/s.

According to an aspect of the present invention there is provided a compact mass spectrometer having a volume less than about 0.1 $m^3$ comprising:

an atmospheric pressure ionisation source;

two differential pumping stages between an atmospheric inlet and the mass analyser;

at least one RF ion optic contained in the second differential pumping stage;

one or more turbomolecular vacuum pumps (or intermediate port(s) of a single turbomolecular vacuum pump) which are used to pump at least one of the differential pumping stage(s);

wherein on the stages vacuum pumped using a turbomolecular vacuum pump (or an intermediate port of a turbomolecular vacuum pump) the Nitrogen pumping speed of the pumping port inlet(s) is/are between 11-140 L/s in each of the differential pumping chambers.

According to an aspect of the present invention there is provided a compact mass spectrometer having a volume less than about 0.1 $m^3$ comprising:

an atmospheric pressure ionisation source;

two differential pumping stages between an atmospheric inlet and the mass analyser;

at least one RF ion optic contained in the second differential pumping stage;

one or more turbomolecular vacuum pumps or intermediate port(s) of a single turbomolecular vacuum pump which are used to pump at least one of the differential pumping stage(s);

wherein on the stages vacuum pumped using a turbomolecular vacuum pump or an intermediate port of a turbomolecular vacuum pump the Nitrogen pumping speed of the pumping port inlet(s) is/are between 11-100 L/s in each of the differential pumping chambers; and wherein the length of the RF ion guide(s) in the second differential pumping stage is <12 cm and wherein the pressure-path length for the second stage is between about 0.02 Torr-cm and 0.3 Torr-cm.

According to an aspect of the present invention there is provided a compact mass spectrometer having a volume less than about 0.1 $m^3$ comprising:

an atmospheric pressure ionisation source;

two differential pumping stages between an atmospheric inlet and the mass analyser;

at least one RF ion optic contained in the second differential pumping stage;

a single split flow turbomolecular vacuum pump to pump the analyser and the second differential pumping stage;

wherein on the stages vacuum pumped using the turbomolecular vacuum pump the Nitrogen pumping speed of the pumping port inlets is less than 90 L/s in the analyser chamber and between 11-40 L/s in the second differential pumping chamber;

wherein the pressure path length in the ion guide is between 0.05 and 0.25 Torr-cm, and the ambient pressure in this region is between $2\times10^{-3}$ and $4\times10^{-2}$ mbar; and wherein the pressure in the first differential pumping stage is between approximately 1 to 8 mbar and the gas throughput into this region from the API source is less than about 500 sccm.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix)

2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1:
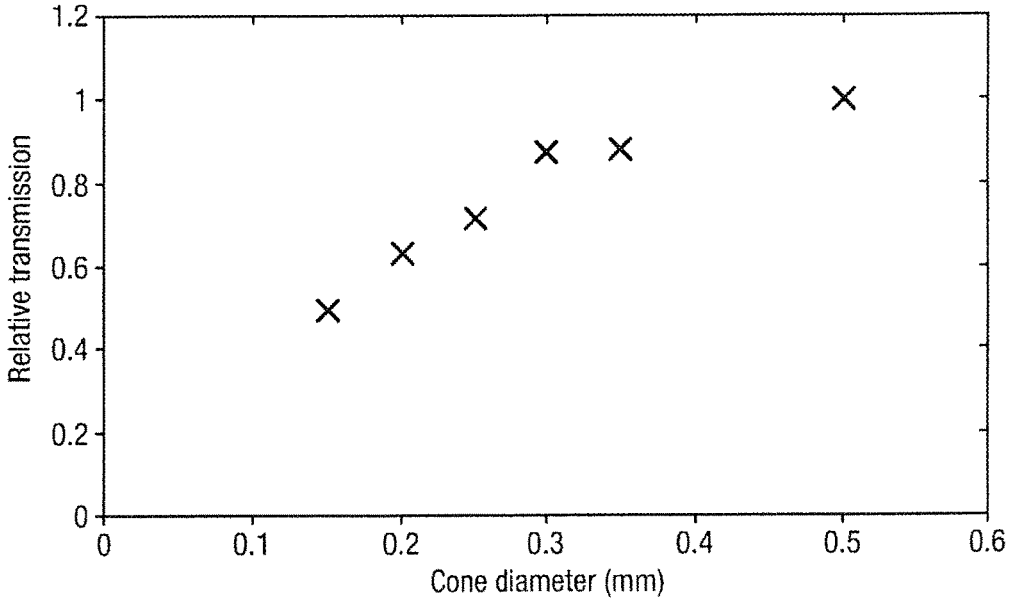
FIG. 1 shows a plot of the relative ion transmission as a function of the diameter of an orifice in an atmospheric sampling cone.
Figure 2:
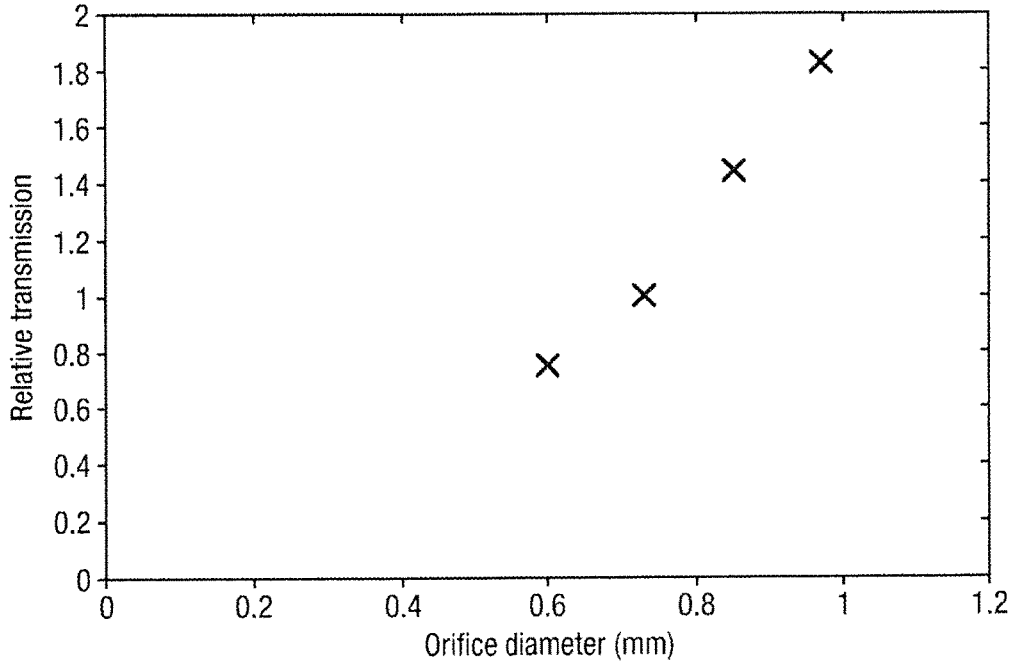
FIG. 2 shows a plot of the relative ion transmission as a function of the diameter of a gas limiting orifice situated between the first two regions of differential pumping of a mass spectrometer.

A preferred embodiment of the present invention will now be described. The preferred embodiment relates to a compact or miniature mass spectrometer which preferably maintains a level of sensitivity similar to current commercial full size mass spectrometers but which is substantially smaller (<0.05 $m^3$ c.f.>0.15 $m^3$ for a conventional full size instrument), lighter (<30 kg c.f.>70 kg) and less expensive.

The preferred miniature mass spectrometer utilises a small backing vacuum pump and a small turbomolecular vacuum pump with considerably lower pumping speeds (<70 L/s c.f.>300 L/s for a full size turbomolecular vacuum pump and <5 $m^3$/h c.f.>30 $m^3$/h for the backing vacuum pump) than a conventional full size mass spectrometer and which consequently consumes considerably less electricity and generates considerably less heat and noise than a conventional full size mass spectrometer.

The preferred mass spectrometer is preferably used for real time on-line analysis of samples separated using high pressure or ultra-high pressure liquid chromatography (HPLC/UHPLC). As such, the sensitivity of the mass spectrometer is commonly described in terms of the signal-to-noise of the mass spectral intensity obtained for a given quantity of a specified molecule as it elutes from the liquid chromatography (LC) system. For example, the sensitivity specification for a conventional full size mass spectrometer comprising a single quadrupole mass spectrometer is that a 1 pg on column injection (5 μL of 0.2 pg/μL) of Reserpine should give a chromatographic signal-to-noise (S:N) for m/z 609 greater than 120:1.

The ability to detect less material on column at the same signal-to-noise level or a higher signal-to-noise value for the same material on column would both correspond to improved sensitivity. A common way of specifying the ultimate sensitivity of a mass spectrometer is by quoting a limit of detection ("LOD") figure or a limit of quantitation ("LOQ") figure. Typically LOD is taken to mean a S:N of 3:1 and LOQ is taken to mean a S:N of 10:1.

Published data for the known miniature mass spectrometer manufactured by Microsaic states that the LOD is 5 ng on column for this instrument i.e. it requires 5000× times more material on column (5 ng c.f. 1 pg) to obtain a significantly worse S:N (3:1 c.f. 120:1). When accounting for a large post-column split the actual LOD for the Microsaic mass spectrometer is approximately 1 pg. By way of contrast, a limit of quantitation (LOQ) for a prototype miniature mass spectrometer according to an embodiment of the present invention is around 0.1 pg of material on column. The LOD is below this level and highlights the sensitivity benefits of the miniature mass spectrometer according to the present invention compared with the known miniature mass spectrometer. Furthermore, the improvement in sensitivity according to the present invention affords a greater linear dynamic range. According to published data for the Microsaic instrument the instrument has a linear dynamic range of, at best, 0.5 pg/mL to 65 μg/mL which is equivalent to approximately 2 orders of magnitude. In contrast, the mass spectrometer according to the preferred embodiment of the present invention is capable of producing linearity data across 4 orders of dynamic range.

Figure 3:
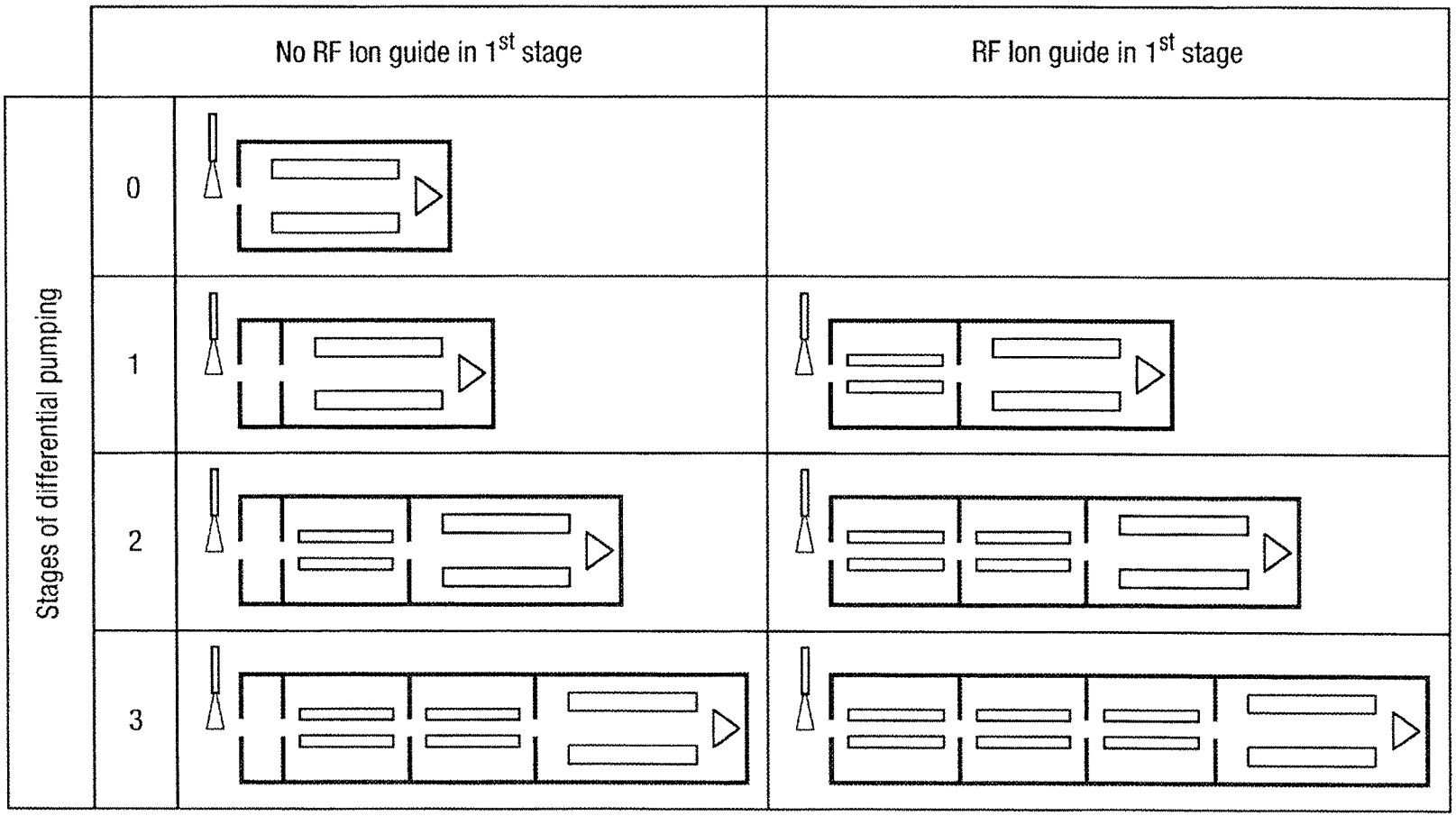
FIG. 3 shows a table showing schematic representations of different arrangements of mass spectrometers with increasing numbers of differential pumping stages and with and without an RF ion guide being provided in the first stage.

FIG. 3 summarises the basic differential pumping schemes that could potentially be used with a mass spectrometer where the number of differential pumping stages varies between zero and three and the first stage of differential pumping either does or does not contain an RF ion guide.

The term RF ion guide in this context relates to (but is not limited to) such devices as quadrupoles, hexapoles, octopoles, multipoles, stacked ring ion guides, travelling wave ion guides, ion funnels, etc. and/or combinations thereof. FIG. 3 shows by way of example only, the differential pumping schemes in front of a single quadrupole mass analyser and an ion detector. The differential pumping stages may be vacuum pumped by turbomolecular and/or drag and/or diffusion and/or rotary and/or scroll and/or diaphragm vacuum pumps.

Differential pumping schemes with zero or one stage are not typically encountered due to the large pressure drop between stages necessitating either small orifices or large vacuum pumps.

As the number of differential pumping stages increases it can be seen that this leads to a corresponding increase in the overall length of the mass spectrometer. Likewise, the inclusion of an RF ion guide within a stage of differential pumping also leads to an increase in the length of the mass spectrometer.

To produce a mass spectrometer that is as small as possible it is therefore beneficial to minimise the number of differential pumping stages and to minimise the number of ion guides used. However, this is at odds with the requirement of either larger vacuum pumps or smaller orifices with fewer differential pumping stages leading to an overall bigger mass spectrometer or one which is insensitive.

The inventors have determined that an optimal configuration exists in which the size of the mass spectrometer can be reduced to fit in a compact form factor, which utilises small vacuum pumps and yet also provides a level of sensitivity which corresponds to that obtained from a conventional full size state of the art mass spectrometer.

Figure 4:
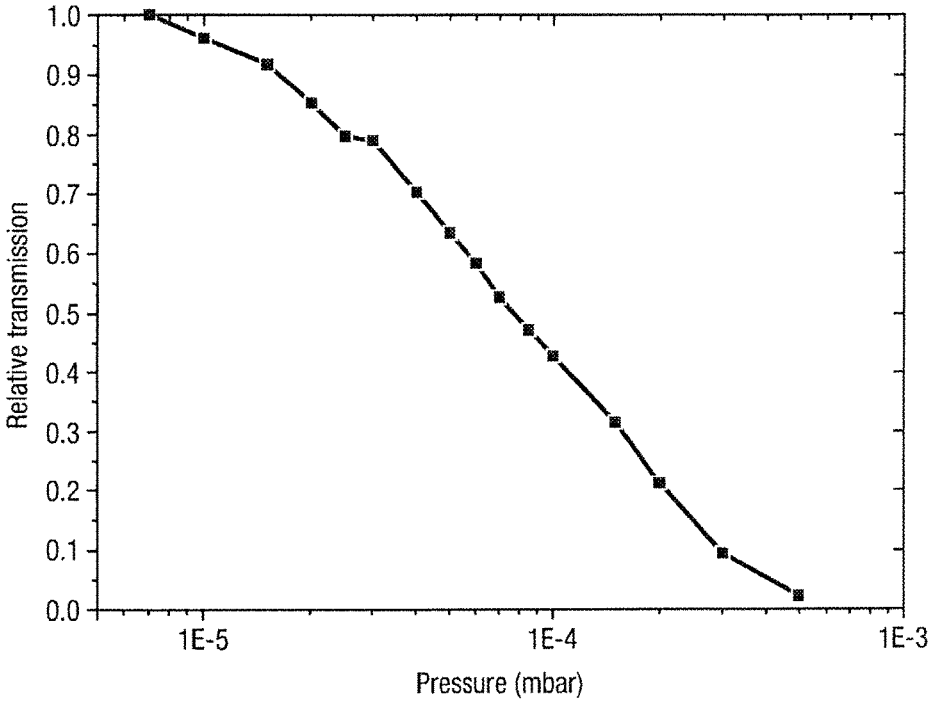
FIG. 4 shows a plot of the ion transmission through a quadrupole mass filter as a function of the vacuum pressure at which the mass filter is operated.

The inventors have recognised that the pressure in the region containing the mass analyser (in this case a quadrupole mass filter) can be allowed to increase substantially without severely affecting the sensitivity. Example data is provided in FIG. 4 which depicts the relative transmission of ions through a resolving quadrupole as a function of the pressure in the region in which the quadrupole is located. In this example the length of the quadrupole was approximately 13 cm and its field radius r0 (i.e. the radius of the inscribed circle within the four rods of the quadrupole) was approximately 5.3 mm. It should be noted that the horizontal axis (vacuum pressure) in FIG. 4 is logarithmic as data were acquired over a wide range of pressures. A change in pressure from $7\times10^6$ mbar to $7\times10^5$ mbar can be seen to result in a reduction in ion transmission to approx. 52%. Therefore, despite the pressure increasing by an order of magnitude (10×) the transmission is only reduced by a factor of two (2×).

The loss of transmission at higher pressures is due to collisions of the ions with residual gas molecules which can either neutralise the ion of interest or cause it to collide with one of the quadrupole rods or otherwise become unstable and be lost to the system. Essentially this is a mean free path (mfp) phenomenon where the increasing pressure and therefore increasing number of background gas molecules leads to a reduction of the average distance an ion will travel before undergoing a collision.

The inventors have also recognised that by reducing both the length of the quadrupole and its field radius, the probability of an ion colliding at a given pressure is less than that for the larger quadrupole. To a first approximation, for example, a reduction in both length and field radius to two thirds of the length/radius of a regular sized quadrupole offsets the reduction in transmission by allowing the background pressure to increase by an order of magnitude. To a first approximation then, using a smaller quadrupole allows a smaller turbo vacuum pump to be used to pump the analyser region (resulting in a pressure increase) without adversely effecting overall ion transmission.

Figure 5A:
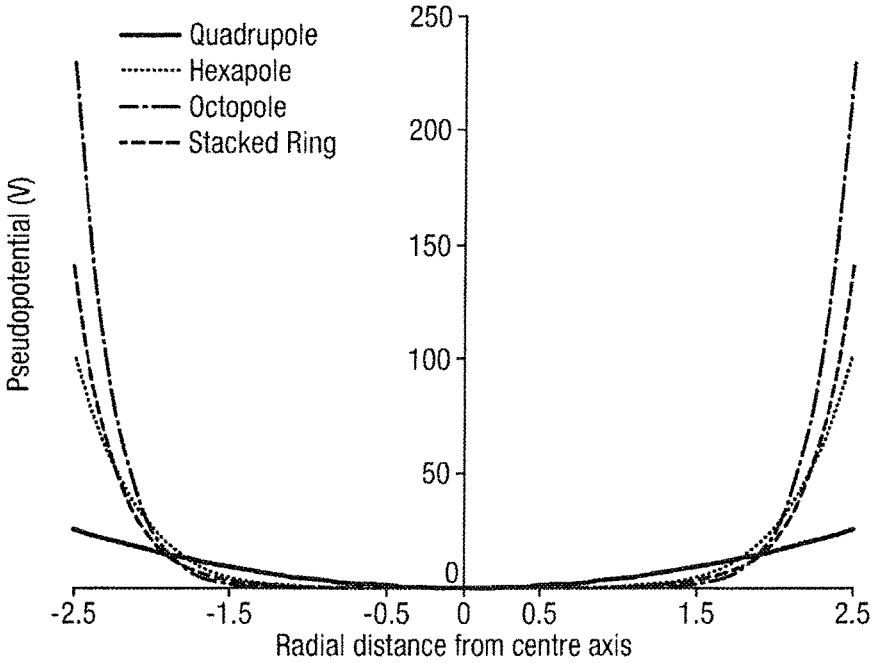
FIG. 5A shows a plot of the pseudo potential formed within RF ion guides of different geometries and FIG. 5B shows a plot of the pseudo potential formed within RF ion guides of different geometries over a restricted pseudo-potential range in order to highlight the different focussing characteristics of the ion guides.
Figure 5B:
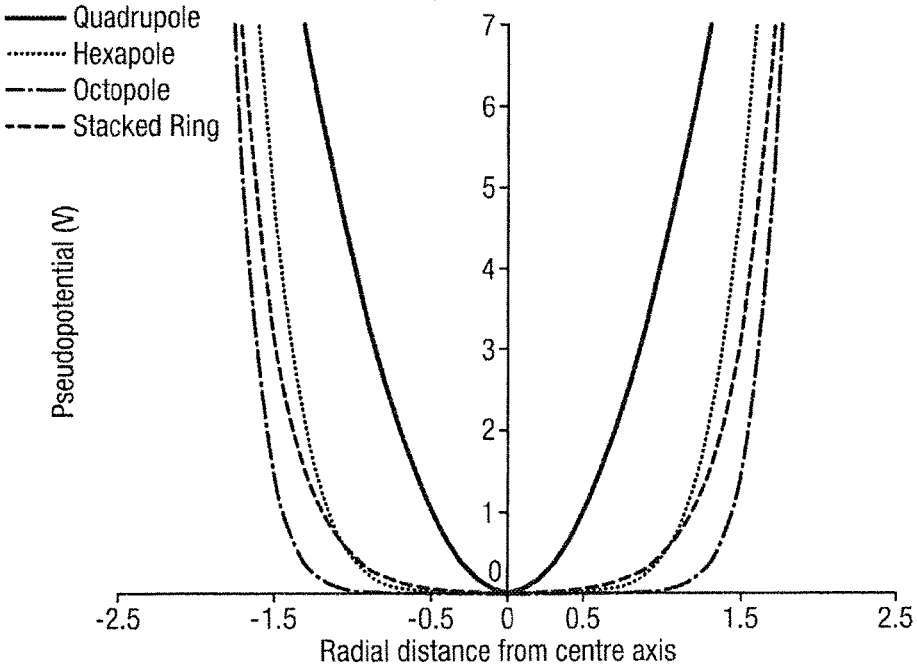

Conventionally higher order multipoles (e.g. hexapoles or octopoles) or stacked ring ion guides are used as ion guides to efficiently transport ions through a differential pumping region. These types of ion guide are preferred for two reasons. Firstly, the form of the pseudo potential of higher order multipoles and stacked ring ion guides are flatter in the centre of the ion guide and also have steep walls, both of which aids in the initial capture of the ions entering the differential pumping region through a gas limiting orifice. These can be compared in FIGS. 5A and 5B which plots the pseudo potential well depth for a quadrupole, a hexapole, an octopole and a stacked ring ion guide all operated under the same RF voltage conditions and having the same inscribed diameter. Secondly, these devices have a broader mass transmission window for a set operating condition (RF frequency, RF voltage amplitude etc) than quadrupoles. However, the advantage of using quadrupole ion guides is that they are better at focussing ions to the central ion optical axis which then makes it easier to focus the ions into and through a small orifice at the exit of the ion guide and into the subsequent vacuum chamber. This is highlighted in FIG. 5B which shows the same data as FIG. 5A but wherein the vertical scale has been limited to allow the form of the pseudo potential at the very centre of the ion guides to be compared. It is apparent from FIG. 5B that the pseudo-potential for a quadrupole ion guide is steeper leading to an improved focussing behaviour.

Figure 6:
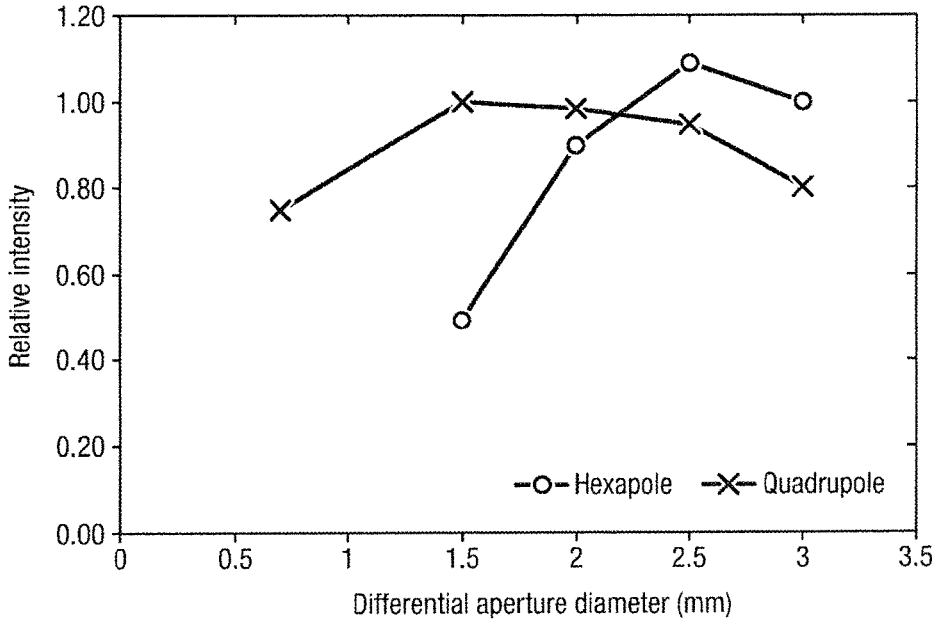
FIG. 6 shows a plot of the relative ion transmission as a function of the diameter of a gas limiting orifice situated between the second region of differential pumping and a chamber housing a mass analyser when the RF ion guide used was either a quadrupole or a hexapole.

The inventors have also recognised that for smaller exit orifices, the advantage of better ion focussing through the exit aperture outweighs the disadvantage of poorer initial ion capture at the entrance of the ion guide. This is highlighted in FIG. 6 which plots the normalised transmission through exit apertures of various diameter for both hexapole and quadrupole ion guides. As can be seen from the data, when a smaller 1.5 mm orifice is used in place of a 3 mm orifice, the transmission through the smaller orifice is superior for the quadrupole ion guide by a factor of at least two and is only slightly worse than the best transmission obtained using a hexapole with any diameter. Thus, by using a quadrupole ion guide in place of a hexapole ion guide a smaller orifice may be used without adversely reducing ion transmission.

Furthermore, the smaller orifice reduces the gas flow into the subsequent vacuum chamber and hence allows a vacuum pump with lower pumping speed to be utilised in the mass analyser chamber whilst maintaining the same vacuum pressure. Alternatively, using a smaller orifice allows the pressure in the ion guide to be increased without increasing the gas flow into the subsequent chamber.

Ion transmission through a quadrupole ion guide optimises at a particular figure of merit referred to as the pressure-path length. To obtain the pressure-path length figure the length of the ion guide in cm is multiplied by the vacuum pressure in the chamber in Torr to give a value in units of Torr-cm. The inventors have recognised that for a miniature or compact mass spectrometer the length of the ion guide should be shorter than in conventional mass spectrometers and that to maintain the pressure-path length at an optimum value the vacuum pressure in the region should be increased in compensation. Normally allowing the pressure to increase in this region would increase the gas flow into the subsequent vacuum chamber resulting in either an increase in pressure in the subsequent chamber or the need to use a vacuum pump with a larger pumping speed. However, as described above, the use of a quadrupole ion guide allows the exit orifice to be smaller and so an increase in pressure can be balanced with a constriction of the exit orifice leading to no net change in the gas flow into the mass analyser chamber. Additionally, and also as described above, the use of a smaller analytical quadrupole allows higher pressures in the analyser region to be tolerated in the case where the pressure rise in the ion guide region cannot be totally compensated for with a decrease in the exit orifice without reducing ion transmission.

Figure 7:
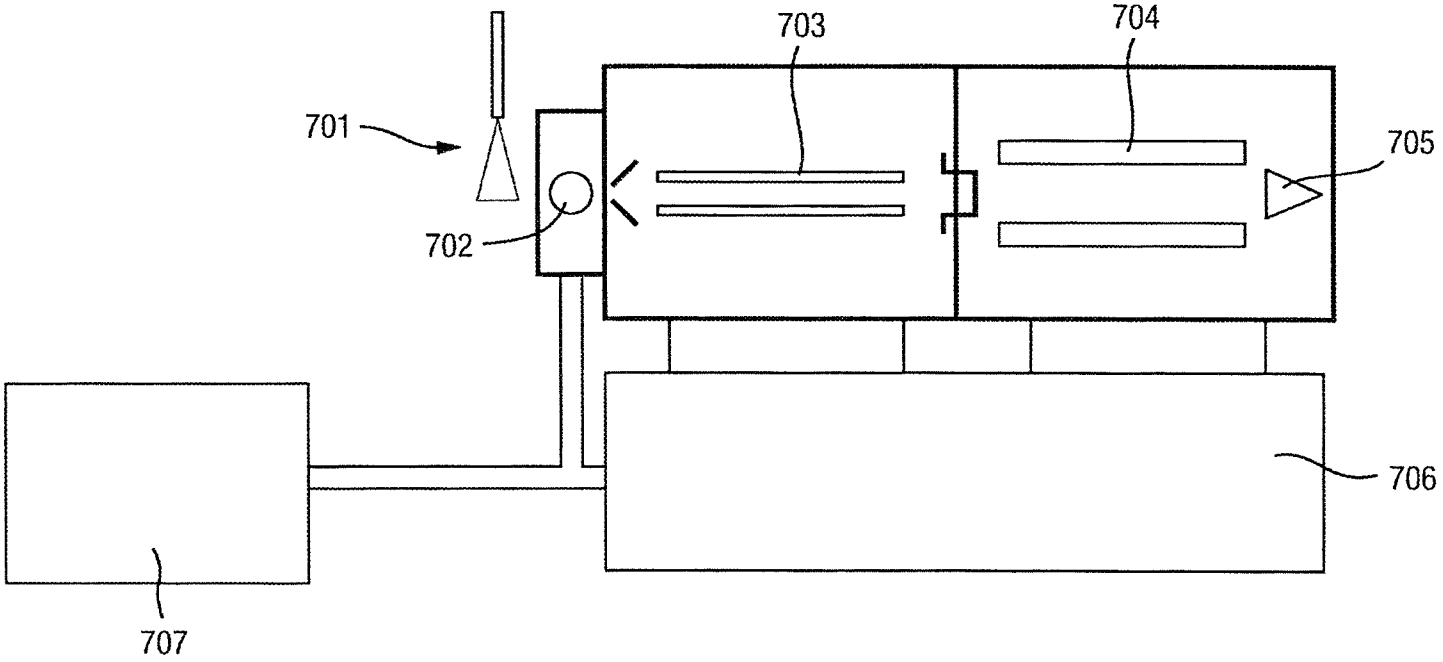
FIG. 7 shows a schematic representation of a compact mass spectrometer according to an embodiment of the present invention.

FIG. 7 is a schematic representation of a preferred embodiment of the present invention comprising an Electrospray Ionisation ion source 701 operating at atmospheric pressure. Ions are sampled through a small orifice 702 into a first differential pumping region and are then directed through a second orifice into a second differential pumping region. A short quadrupole ion guide 703 is located in the second vacuum chamber and efficiently transports the ions through the second differential pumping stage and directs the ions to a third orifice and into an analyser chamber containing a small quadrupole mass filter 704 and an ion detector 705. A small splitflow turbomolecular pump 706 is preferably used to pump both the analyser region (using the main HV pumping port) and the second differential pumping stage (using the intermediate/interstage port). The turbomolecular pump is preferably backed by either a small rotary vane pump or a small diaphragm pump 707 which is also used to pump the first differential pumping stage.

According to the preferred embodiment a quadrupole ion guide is provided. However, according to other embodiments a hexapole, octopole, ion funnel, ion tunnel, travelling wave (wherein one or more transient DC voltages are applied to the electrodes of the ion guide) or a conjoined ion guide may instead be provided.

According to the preferred embodiment a turbomolecular vacuum pump with an intermediate pumping port is preferably used. However, two (or more) separate turbomolecular vacuum pumps may instead be used according to a less preferred embodiment.

According to a further embodiment of the present invention the mass analyser may comprise a mass analyser other than a quadrupole mass analyser. For example, according to an embodiment of the present invention the mass analyser may comprise a tandem quadrupole mass analyser, a 3D ion trap mass analyser, a 2D or linear ion trap mass analyser, a Time of Flight mass analyser, a quadrupole-Time of Flight mass analyser or an electrostatic or Orbitrap® mass analyser.

According to an embodiment, one or more ion mobility devices may be provided prior to the ion sampling inlet and/or inside one of the vacuum chambers.

Although the preferred embodiment relates to an embodiment comprising three vacuum chambers wherein the mass analyser is located in the third mass analyser, other embodiments are contemplated comprising two, four, five or more than five vacuum chambers. An embodiment is contemplated wherein the first RF ion guide is located in the first vacuum chamber but the mass analyser is located in a third and/or fourth vacuum chamber. For example, a quadrupole-Time of Flight mass analyser may be provided wherein the quadrupole mass filter is provided in the third vacuum chamber and the miniature Time of Flight mass analyser is provided in a fourth vacuum chamber downstream of the third vacuum chamber.

According to an embodiment one or more further vacuum chambers may be provided upstream and/or downstream of the first vacuum chamber and/or the second vacuum chamber and/or the third vacuum chamber.

According to an embodiment the first vacuum pump pumping the first vacuum chamber may have an increased pumping speed of up to 20 $m^3$/hr.

According to an embodiment the first vacuum chamber may be pumped using a booster port of a turbomolecular pump.

According to an embodiment the second vacuum pump pumping the second vacuum chamber and/or the third vacuum pump pumping the third vacuum chamber may have an increased pumping speed of up to 100, 150 or 200 L/s.

According to an embodiment if four or more vacuum chambers are provided then a splitflow turbomolecular pump may be utilised having two or more interstages. The second vacuum chamber may be pumped by a first interstage of the turbomolecular pump and the third vacuum chamber may be pumped by a second interstage of the turbomolecular pump. The fourth or final vacuum chamber may be pumped by the high vacuum stage of the turbomolecular pump.

Although the present invention has been described with reference to preferred embodiments, it will be understood by those skilled in the art that various changes in form and detail may be made without departing from the scope of the invention as set forth in the accompanying claims.

The invention claimed is:

1. A miniature mass spectrometer comprising:

an atmospheric pressure ionisation source; and a first vacuum chamber having an atmospheric pressure sampling orifice or capillary, a second vacuum chamber located downstream of the first vacuum chamber and a third vacuum chamber located downstream of the second vacuum chamber;

wherein the mass spectrometer further comprises:

an RF ion guide located within the second vacuum chamber and wherein the product of the pressure P in the vicinity of the RF ion guide and the length L of the RF ion guide is in the range 0.05-0.3 mbar-cm; and a fourth vacuum chamber located downstream of the third vacuum chamber.

2. The miniature mass spectrometer as claimed in claim 1, further comprising a first vacuum pump arranged and adapted to pump the first vacuum chamber, wherein the first vacuum pump has a maximum pumping speed <10 $m^3$/hr (2.78 L/s).

3. The miniature mass spectrometer as claimed in claim 1, wherein the first vacuum chamber is maintained at a pressure <25 mbar.

4. The miniature mass spectrometer as claimed in claim 1, wherein the product of the pressure $P_1$ in the first vacuum chamber and the length $L_1$ of the first vacuum chamber is in the range 10-100 mbar-cm.

5. The miniature mass spectrometer as claimed in claim 1, further comprising one or more vacuum pumps arranged and adapted to pump the second vacuum chamber at a maximum rate of <70 L/s.

6. The miniature mass spectrometer as claimed in claim 1, wherein the second vacuum chamber is maintained at a pressure in the range 0.001-0.1 mbar.

7. The miniature mass spectrometer as claimed in claim 1, wherein the product of the pressure P in the vicinity of the RF ion guide and the length L of the RF ion guide is in the range 0.1-0.3 mbar-cm.

8. The miniature mass spectrometer as claimed in claim 1, wherein the third vacuum chamber is maintained at a pressure <0.0003 mbar.

9. The miniature mass spectrometer as claimed in claim 1, wherein the RF ion guide comprises a dual conjoined stacked ring ion guide, a multipole ion guide, a stacked ring ion guide or an ion funnel ion guide.

10. The miniature mass spectrometer as claimed in claim 1, wherein the RF ion guide comprises a quadrupole ion guide.

11. The miniature mass spectrometer as claimed in claim 1, further comprising a second RF ion guide located within the first vacuum chamber, wherein the second ion guide comprises dual conjoined stacked ring ion guide, a multipole ion guide, a stacked ring ion guide or an ion funnel ion guide.

12. The miniature mass spectrometer as claimed in claim 11, wherein the RF ion guide and/or the second RF ion guide has a length <100 mm.

13. The miniature mass spectrometer as claimed in claim 1, further comprising and an ion detector located in the third or fourth vacuum chamber.

14. The miniature mass spectrometer as claimed in claim 1, further comprising a quadrupole mass filter arranged in the third vacuum chamber, and a Time of Flight mass analyser arranged in the fourth vacuum chamber.

15. The miniature mass spectrometer as claimed in claim 1, further comprising one or more collision, fragmentation or reaction cells arranged in the second, third or fourth vacuum chamber.

16. The miniature mass spectrometer as claimed in claim 1, wherein the ion path length from the atmospheric pressure sampling orifice or capillary to an ion detecting surface of an ion detector is <400 mm.

17. The miniature mass spectrometer as claimed in claim 1, wherein the total internal volume of the first, second and third vacuum chambers is ≤2000 $cm^3$.

18. A method of mass spectrometry comprising:

providing a miniature mass spectrometer comprising an atmospheric pressure ionisation source, a first vacuum chamber having an atmospheric pressure sampling orifice or capillary, a second vacuum chamber located downstream of the first vacuum chamber and a third vacuum chamber located downstream of the second vacuum chamber, a fourth vacuum chamber located downstream of the third vacuum chamber; and passing analyte ions through an RF ion guide located within the second vacuum chamber; and maintaining the product of the pressure P in the vicinity of the RF ion guide and the length L of the RF ion guide in the range 0.05-0.3 mbar-cm.

19. A miniature mass spectrometer comprising:

an atmospheric pressure ionisation source, wherein the atmospheric pressure sampling orifice or capillary has a diameter ≤0.3 mm;

a first vacuum chamber having an atmospheric pressure sampling orifice or capillary, a second vacuum chamber located downstream of the first vacuum chamber and a third vacuum chamber located downstream of the second vacuum chamber;

a differential pumping aperture or orifice between the first vacuum chamber and the second vacuum chamber, wherein the differential pumping aperture or orifice between the first vacuum chamber and the second vacuum chamber has a diameter ≤1.5 mm;

a differential pumping aperture or orifice between the second vacuum chamber and the third vacuum chamber, wherein the differential pumping aperture or orifice between the second vacuum chamber and the third vacuum chamber has a diameter ≤2.0 mm;

an ion detector; and an RF ion guide located within the second vacuum chamber, wherein the RF ion guide comprises a quadrupole ion guide, and wherein the RF ion guide has a length <100 mm;

wherein the ion path length from the atmospheric pressure sampling orifice or capillary to an ion detecting surface of the ion detector is ≤400 mm; and wherein the mass spectrometer further comprises a fourth vacuum chamber located downstream of the third vacuum chamber.

* * * * *